United States Patent [19]

Iida

[11] 4,329,923

[45] May 18, 1982

[54] INKING CONTROL APPARATUS FOR PRINTING MACHINES

[75] Inventor: Mitsuhiko Iida, Zama, Japan

[73] Assignee: Toshiba Kikai Kabushiki Kaisha, Tokyo, Japan

[21] Appl. No.: 219,579

[22] Filed: Dec. 23, 1980

[30] Foreign Application Priority Data

Dec. 27, 1979 [JP] Japan ..... 54-170923

[51] Int. Cl.[3] ..... B41F 31/04; B41F 31/06

[52] U.S. Cl. ..... 101/365; 101/DIG. 26

[58] Field of Search ..... 101/365, 349, 350, 351, 101/352, 206, 207, 208, 209, 210, 363, 148, DIG. 26; 118/261

[56] References Cited

U.S. PATENT DOCUMENTS

| | | | |
|---|---|---|---|
| 3,057,294 | 10/1962 | Jameson | 101/365 |
| 3,747,524 | 7/1973 | Crum | 101/365 |
| 3,792,659 | 2/1974 | Albrecht | 101/365 |
| 3,968,746 | 7/1976 | Gaillochet | 101/365 |

FOREIGN PATENT DOCUMENTS

| | | | |
|---|---|---|---|
| 2007594 | 5/1979 | United Kingdom | 101/365 |

*Primary Examiner*—J. Reed Fisher

*Attorney, Agent, or Firm*—Koda and Androlia

[57] ABSTRACT

In a printing machine of the type wherein the quantity of ink is adjusted by varying a gap between an inking roller and an adjusting piece there are provided an actual position representing unit which stores a data corresponding to a gap width, a reference position setting unit for the adjusting piece at which the ink does not leak out, a comparator comparing outputs of the actual position representing unit and the reference position setting unit, an inking roller rotating state judging unit which produces a stop signal when the inking roller stops, and a gate circuit responsive to the stop signal and the output of the comparator for moving the adjusting piece. The control circuit is constructed to maintain the adjusting piece at the reference position when the inking roller is stopped.

5 Claims, 10 Drawing Figures

INKING CONTROL APPARATUS FOR PRINTING MACHINES

BACKGROUND OF THE INVENTION

This invention relates to an inking or ink feed control apparatus for use in a printing machine, and more particularly an inking control apparatus capable of preventing leakage of printing ink from an ink reservoir while an inking roller is stopped to rotate and wherein while the inking roller is rotating when a stop button is depressed the inking quantity under this state is stored in a memory device so as to ensure the quantity of ink which was supplied before stop at the time when the rotation of the inking roller is started again.

A prior art inking device of a printing machine comprises an inking roller 11, an inking blade 12 made of a single thin plate and a plurality of adjusting screws 13 for moving the inking blade 12 forward and away from the inking roller, as shown in FIG. 1A, the adjusting screws being spaced from each other in the direction perpendicular to the sheet of drawing.

Where it is desired to remotely control the inking device, the adjusting screws are driven by an electric motor 14 through gears $\mathbf{13}_a$ and $\mathbf{14}_a$, as shown in FIG. 1B.

Where the inking blade 12 is constituted by a single blade, rotation of an adjusting screw at a certain position influences the relationship between the blade 12 and an adjusting screw, not shown, at another position, thus making it difficult to accurately control the quantity of ink fed. Then, as shown in FIG. 1C, it has been proposed to divide the inking blade 12 into a plurality of sections 12A through 12E and to drive these sections by independent adjusting screws, not shown.

According to a subsequently proposed improvement, the inking device is constructed such that the quantity of ink fed would be determined by a balance between the film pressure of the ink leaking through a gap between the inking roller and the divided inking blades and the flexure of inking blades caused by the adjusting screws. The hydrodynamic pressure is greatly influenced by the viscosity of the ink and the velocity of inking roller, that is the number of revolutions of the inking roller so that in such control device for controlling the quantity of ink fed according to the balance of forces, satisfactory control is difficult. Recently, adjusting pieces having metal edges that can be considered as split solids have been substituted for the split thin plate blades for controlling the gaps between the adjusting pieces and the inking roller.

According to another prior art control device shown in FIG. 2, ink 28 in an ink reservoir is fed through a small gap between an inking roller 21 and adjusting pieces 22 actuated by adjusting screws 23. Each adjusting piece is urged against one end of each adjusting screw 23 by a spring 24 interposed between an arm 22A integral with the adjusting piece 22, and the stationary frame F. Each adjusting piece is pivotally mounted on a shelf of the stationary frame. The adjusting screws are rotated by electric motors 25.

This construction can reduce the adverse effect of the viscosity and flow speed of the ink upon the quantity of ink fed through small gaps between adjusting pieces and the inking roller 21.

The prior art control device shown in FIG. 2 accompanies a problem not found in that shown in FIG. 1. More particularly, according to the prior art control device utilizing thin blades, since the quantity of ink is controlled by the balance of forces, as the inking roller stops, the ink film pressure disappears so that the blades which have been maintained in their operating positions by the flexure given to the blades by adjusting screw rods would be urged against the periphery of the inking roller thus preventing the leakage of the ink from the ink reservoir.

Substantially rigid adjusting pieces shown in FIG. 2 do not flex to any appreciable amount, the gaps between them and the inking roller are not influenced by the rotation and stoppage of the inking roller with the result that ink leaks through the gaps a predetermined time after the stoppage of the inking roller.

The ink thus leaked enters into the driving member of the inking roller thus damaging the same. When the printing machine is stopped over a long time, the loss of ink is substantial.

SUMMARY OF THE INVENTION

Accordingly, it is an object of this invention to provide a novel inking control apparatus for a printing machine capable of maintaining the gaps between an inking roller and adjusting pieces at a small value, usually of the order of several microns, that is sufficient to prevent leakage of ink while the inking roller is stopped.

Another object of this invention is to provide an electric inking control apparatus capable of electrically controlling the operating and nonoperating positions of the adjusting pieces.

According to one embodiment of this invention there is provided inking control apparatus for use in a printing machine including an inking roller, an adjusting piece confronting the inking roller for defining therebetween an ink reservoir and an adjustable gap communicated with the ink reservoir for supplying a quantity of ink, and drive means for reciprocating the adjusting piece toward and away from the inking roller to adjust the gap to a predetermined width, characterized in that the inking control apparatus comprises actual position representing means for storing data corresponding to the gap width between the inking roller and the adjusting piece for representing an actual position thereof; reference position setting means for setting a reference position for the adjusting piece, the reference position forming a gap between the inking roller and the adjusting piece of a width sufficient to prevent the ink from leaking through the gap; comparator means for comparing outputs of the actual position representing means and the reference position setting means for producing an output until the outputs coincide with each other; inking roller rotating state judging means which produces a stop signal when the inking roller stops to rotate or approaches to a stop state; and gate circuit means supplied with the output of the comparator means for operating the drive means in accordance with the stop signal thereby maintaining the adjusting piece at the reference position while the inking roller is being stopped.

According to another embodiment of this invention, there is provided inking control apparatus for use in a printing machine including an inking roller, an adjusting piece confronting the inking roller for defining therebetween an ink reservoir and an adjustable gap communicated with the ink reservoir for supplying a quantity of ink, and drive means for reciprocating the adjusting piece toward and away from the inking roller to adjust the gap to a predetermined width, characterized in that the inking control apparatus comprises actual position representing means for storing data corresponding to the gap width between the inking roller and the adjusting piece for representing an actual position thereof; reference position setting means for setting a reference position for the adjusting piece, the reference position forming a gap between the inking roller and the adjusting piece of a width sufficient to prevent the ink from leaving through the gap; inking roller rotating state judging means which produces a stop signal when the inking roller stops to rotate or approaches to a stop state, and a start signal when the inking roller is rotating at a predetermined speed or at a starting condition; memory means; means responsive to the stop signal for transferring data regarding the actual position of the adjusting piece stored in the actual position representing means to the memory means; comparator means which compares content of the actual position representing means with that of the reference position setting means when the stop signal is applied for producing a first output until the compared contents coincide with each other, and compares the content of the actual position representing means with that of the memory means when the start signal is given for producing a second output until the compared contents coincide with each other; transfer gate means responsive to the start and stop signals for supplying the contents of the actual position setting means and the memory means; and gate means responsive to the first and second outputs of the comparator means for applying a drive signal to the drive means for moving the adjusting piece toward and away from the inking roller.

DESCRIPTION OF THE PREFERRED EMBODIMENTS

Figure 1A:
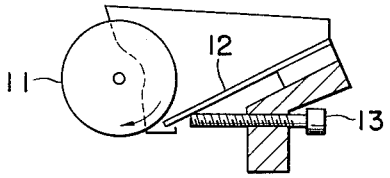
FIG. 1A PRIOR ART
FIGS. 1A–1C and FIG. 2 show some of prior art control devices for adjusting the quantity of ink fed by an inking roller.
Figure 1B:
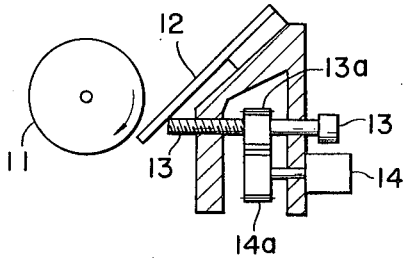
FIG. 1B PRIOR ART
Figure 1C:
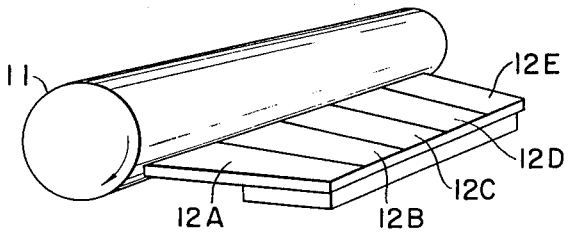
FIG. 1C PRIOR ART
Figure 2:
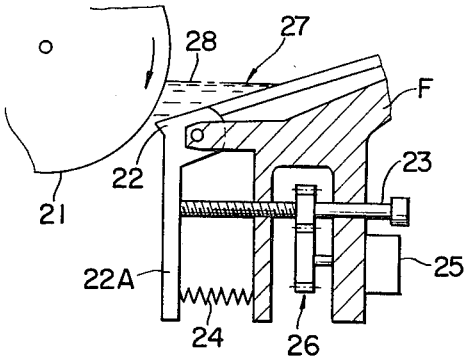
FIG. 2 PRIOR ART
Figure 3:
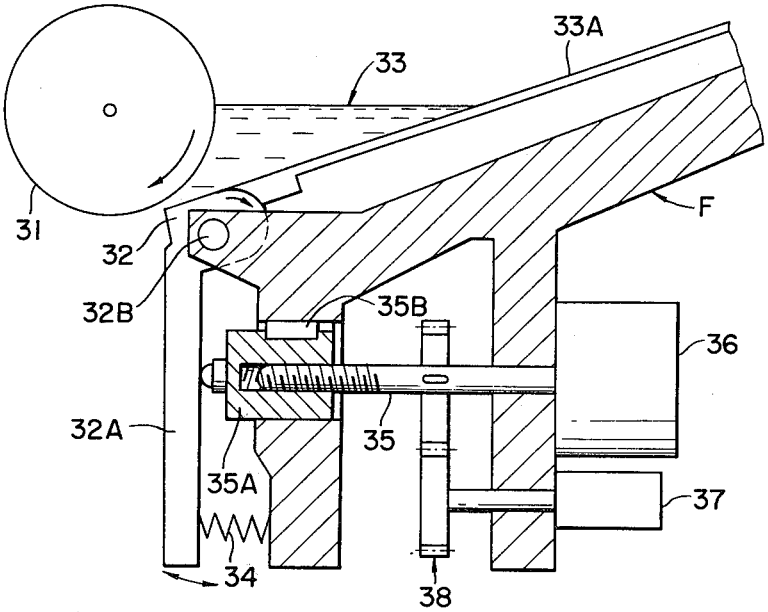
FIG. 3 is a sectional view showing an inking control device controlled by the control apparatus according to this invention.
Figure 4:
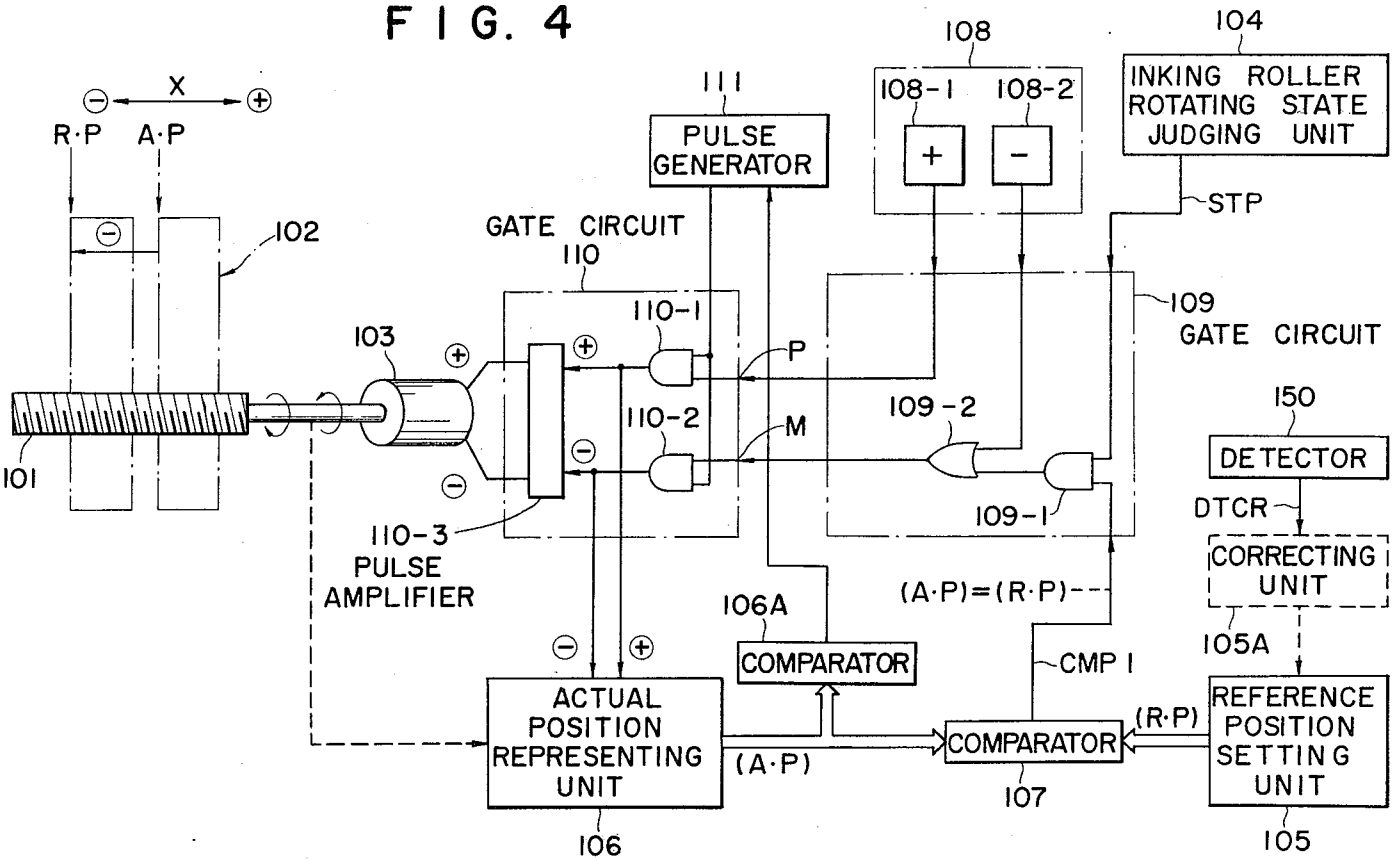
FIG. 4 is a block diagram showing control apparatus embodying the invention that automatically stops the adjusting pieces at reference positions.

FIG. 3 shows an inking control device controlled by the apparatus of this invention and comprises an inking roller 31 and adjusting pieces 32 each having a depending arm 32A pivotally mounted on a frame F by a pivot pin 32B. Each arm 32A is engaged by one end of a nut 35A threaded on an adjusting screw 35 and prevented from rotating by a key 35B. Inclined member 33A is formed integrally with the frame F and in slidable contact with the back portions of the adjusting members 32. Printing ink 33 is contained in a reservoir defined by the inking roller 31, inclined member 33A and adjusting members 32. Each arm 32A is normally pulled against the nut 35A by a tension spring 34 to prevent any backlash therebetween. Each adjusting screw 35 is driven by a stepping motor 36 and a potentiometer resistor 37 is driven by the screw 35 through a gearing 38. In a block diagram shown in FIG. 4 showing electric control apparatus adapted to control the gaps between the inking roller 31 and the adjusting pieces 32 shown in FIG. 3, the adjusting screw is designated by a reference numeral 101, the adjusting piece by 102 and stepping motor by 103. In FIG. 4, the driving mechanism of FIG. 3 is shown simplified such that the adjusting piece 102 is reciprocated directly by the adjusting screw 101 in the directions of ±X. A judging unit 104 is provided for judging the rotating state of the inking roller 31 (FIG. 3). This unit produces a signal STP when the speed of the inking roller decreases below a predetermined number of revolutions. This signal may be a stop instruction signal produced when a stop push button or a switch is operated for the purpose of stopping the inking roller. In any event, it is only necessary to stop the inking roller 31 when the signal STP is issued or at a predetermined time later.

For this reason, this signal STP is termed hereinafter a stop signal. A reference position setting unit 105 is provided to set the adjusting piece 102 to a position at which the ink in the ink reservoir will not leak through the gap (usually of the order of few microns) between the adjusting piece 102 and the inking roller 103. Thus, a value or quantity corresponding to the reference position is stored in the reference position setting unit 105.

An actual position representing unit 106 is set with a value or quantity corresponding to an amount of displacement of the adjusting member from a reference position (R.P). This unit is provided with a display member, not shown. In the following description when reference symbols A.P and R.P are used to represent quantities they are rewritten as (A.P) and (R.P), respectively.

The contents of the actual position representing unit 106 and the reference position setting unit 105 are compared with each other by a comparator 107. Where (A.P)≠(R.P), the comparator 107 applies its output COMP1 (="1") to one input of an AND gate circuit 109-1 of a gate circuit 109.

A manually operated push button device 108 comprises a plus push button 108-1 and a minus push button 108-2. While either one of these push buttons is being depressed the adjusting piece 102 is moved in the plus or minus direction as shown in FIG. 4.

For the purpose of preventing the adjusting piece 102 from colliding against the inking roller when the push buttons 108-1 and 108-2 are continuously depressed, a comparator 106A applies a stop instruction signal to a pulse signal generator 111 to cause it to stop pulse generation. Above described plus and minus positions are set in the comparator 106A so as to normally compare them with the actual position (A.P).

The gate circuit 109 comprises the AND gate circuit 109-1 and an OR gate circuit 109-2. The AND gate circuit 109-1 is supplied with the stop signal STP and the output COMP1 of the comparator 107, whereas the OR gate circuit 109-2 is supplied with the output of the AND gate circuit 109-1 and a signal from the minus push button 108-2. Thus, the gate circuit 109 designates the direction of plus X or minus X of the movement of the adjusting piece 102 not only during an automatic operation but also during a manual operation.

A gate circuit 110 is constituted by AND gate circuits 110-1 and 110-2 and a pulse amplifier 110-3 and respective AND gate circuits are supplied with direction instructions P (plus) and M (minus) produced by the gate circuit 109, push button 108-1 and a pulse signal generated by the pulse generator 111.

The outputs of the AND gate circuits 110-1 and 110-2 are applied to the pulse amplifier 110-3 for driving the stepping motor 103 in the +X and −X directions, respectively.

The output pulses of the AND gate circuits 110-1 and 110-2 are applied to plus and minus input terminals of the present position representing unit 106. With this connection, the unit 106 may be constituted by a reversible counter.

In FIG. 4, when the adjusting piece 102 occupies a reference position R.P the adjusting piece 102 is at a position closest to the inking roller 31 (that is with a minimum gap) so that it can be said that the actual position A.P of the adjusting piece 102 is normally positioned to the right of the reference position R.P. Where the reference position is set to zero, the content of the reference position setting unit 105 is set to zero, whereas that of the present position representing unit is generally set to a positive value. Dotted lines connected to the actual position representing unit 106 means that an analogue input voltage representing the actual position is applied to the unit 106, which corresponds to a case wherein a potentiometer resistor or the like is connected to the adjusting screw 101. As shown by dotted lines in FIG. 4, an output of a correcting unit 105A is applied to the reference position setting unit 105 for the purpose of correcting the reference position when the axis of the inking roller 31 is displaced due to thermal deformation or thermal expansion. To this end, an output signal DTCR from a detector 150 which detects the variation in the distance between the axis of the inking roller 31 and the adjusting piece 102, that is the gap, is applied to the correcting unit 105A so as to correct the set value of the reference position.

The apparatus shown in FIG. 4 operates as follows:

Suppose now that the adjusting piece 102 is at the actual position A.P shown in FIG. 4. Then, a value corresponding to this position would be stored in the actual position representing unit 106, whereas the reference position setting unit 105 is set with a value corresponding to the reference position.

Under these conditions, (A.P)≠(R.P), that is (A.P)>(R.P) and hence the output COMP1 of the comparator 107 is "1". Then, when a stop signal STP is applied to one input of the AND gate circuit 109-1 it is enabled to apply its output to the AND gate circuit 110-2 of the gate circuit 110 through OR gate circuit 109-2 to act as a direction instruction signal M.

In response to this signal M, the AND gate circuit 110-2 is enabled to apply the pulse from the pulse generator 111 to the pulse amplifier 110-3 for driving the stepping motor 103 in the direction to move the adjusting piece 102 in the direction of −X. Since the output of the AND gate circuit 110-2 is also applied to the minus terminal of the actual position representing unit 106, its count would be decreased where it is constituted by a reversible counter.

When the content of the actual position representing unit 106 becomes equal to that of the reference position setting unit 105 the output COMP1 of the comparator 107 becomes "0" thus disenabling the AND gate circuit 110-2, thus blocking the pulse from the pulse generator 111. Accordingly, stepping motor 103 stops to rotate. At this time, the content of the actual position representing unit 106 is equal to that of the reference position setting unit 105, that is (A.P)=(R.P). Thus, the adjusting piece 102 is stopped at the lefthand position. While push button switch 108-1 or 108-2 is being manually operated, signal P or M is applied to the gate circuit 110 so that the stepping motor can also be rotated by manual operation. In this case too, the pulse supplied to the stepping motor 103 is applied to the actual position representing unit 106.

Figures 5, 6:
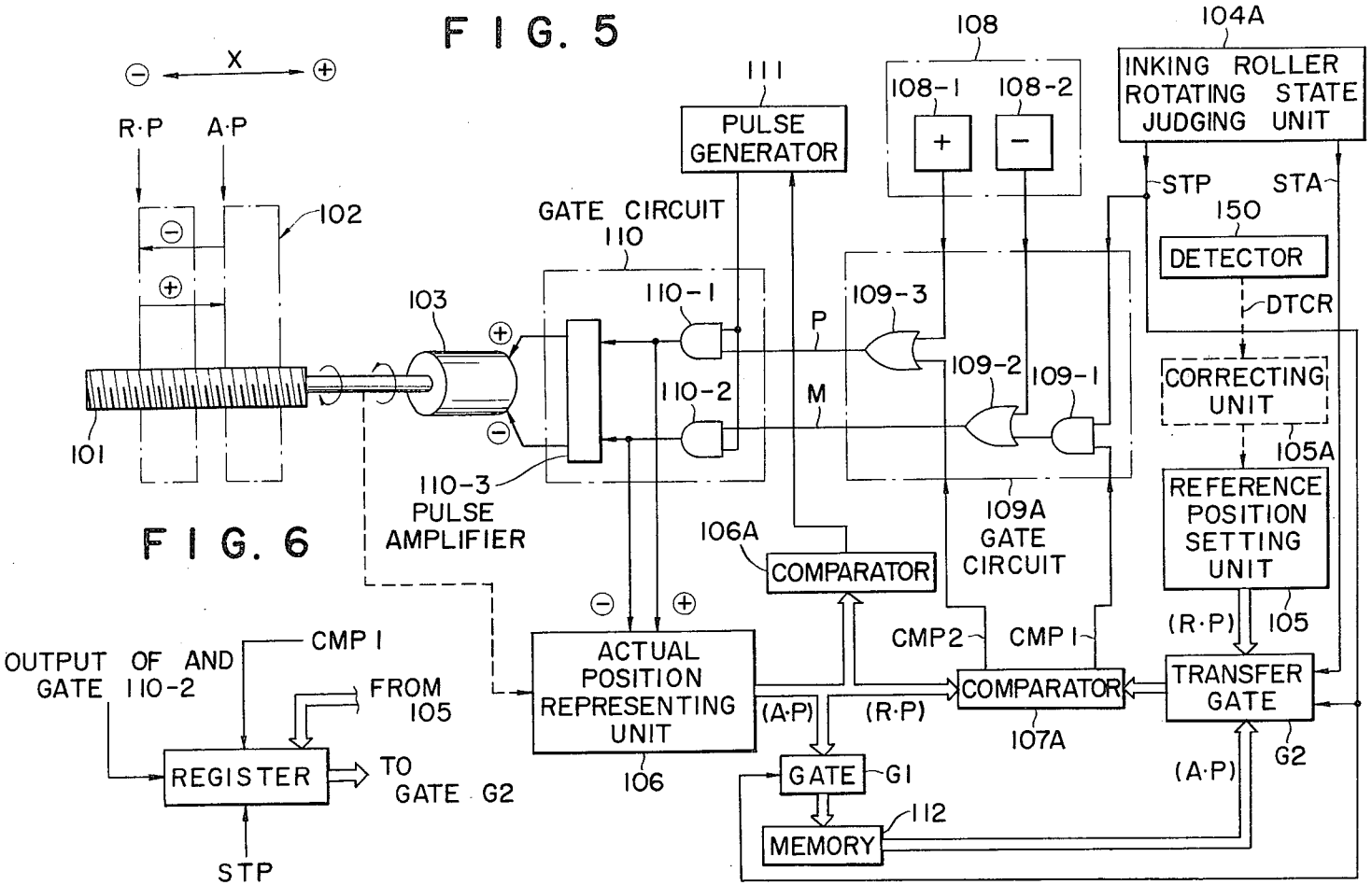
FIG. 5 is a block diagram showing another embodiment of this invention having an additional SAVE function.
FIG. 6 is a block diagram showing another method of applying an input to the memory device shown in FIG. 5.

FIG. 5 shows another embodiment of this invention which is constructed to operate in the same manner as the embodiment shown in FIG. 4 and further to operate such that upon receival of a stop instruction for the inking roller, the actual position at that time is temporarily stored and the adjusting piece 102 is moved to the reference position shown in FIG. 4, and that upon receival of a restart instruction the adjusting piece is returned to the previously stored position. In FIG. 5, circuit elements corresponding to those shown in FIG. 4 are designated by the same reference characters. In addition to those in FIG. 4, the circuit shown in FIG. 5 further comprises a gate circuit G1, a memory device 112, a transfer gate circuit G2. Furthermore a comparator 107A is modified to produce a second output COMP2 utilized as a movement instruction, and an OR gate circuit 109-3 supplied with this comparator output COMP2 is provided for a gate circuit 109A. An inking roller rotating state judging unit 104A is modified to produce a start signal STA in addition to the stop signal STP.

The modification shown in FIG. 5 operates as follows. At first, let us suppose that the adjusting piece 102 is at the actual position A.P and that the inking roller 31 is rotating under a normal state. When the inking roller rotating state judging unit 104A produces a stop signal STP, the gate circuit G1 is enabled to set the deviation (in this case plus) of the adjusting piece 102 from the reference position (R.P), that is the content of the actual position representing unit 106. In response to the stop signal STP, the transfer gate circuit G2 supplies the content (R.P) of the reference position setting unit 105 to the comparator 107A.

Thereafter the comparator 107A gives its first output COMP1="1" to the gate circuit 109A until the content of the actual position representing unit 60 becomes equal to the value, for example zero, of the reference position (R.P).

This output COMP1 is converted into a signal M through AND gate circuit 109-1 and OR gate circuit 109-2. The signal M is applied to the AND gate circuit 110-2 of the gate circuit 110 to rotate the stepping motor 103 to move the adjusting piece 102 toward left. When the adjusting piece 102 reaches the reference point R.P, the stepping motor 103 stops to rotate.

To restart the rotation of the inking roller, the transfer gate circuit G2 is switched to apply to the comparator 107A the content (A.P) stored in the memory device 112. As a consequence, until the content (R.P) of the actual position representing unit 106 coincides with the memory content (A.P) the comparator 107A produces the second output COMP2="1", which is converted into a signal P through OR-gate circuit 109-3. As this signal P is applied to the AND gate circuit 110-1 of the gate circuit 110, the stepping motor 103 moves the adjusting piece 102 in the direction of +X. As a consequence, the adjusting piece 102 is returned to and stopped at the position A.P at which the stop signal was previously given.

The automatic resetting function is herein termed a SAVE function. The purpose of this function in the inking control of a printing machine is to resume, at the time of restarting, a gap between the periphery of the inking roller and the adjusting piece which has been maintained until the inking roller is stopped, and to prevent leakage of the ink during the stop of the inking roller. Considering FIG. 5 from this standpoint, still further modification may be made. More particularly, in the preceding description, it was described that the content (A.P) of the actual position representing unit 106 is rapidly transferred to the memory device 112 according to the stop signal STP. Thus, in FIG. 5, in response to the generation of signal COMP1="1", the content (A.P) of the actual position representing unit 106 is transferred to the memory device 112 before the pulse from the AND gate circuit 110-2 changes the content (A.P). However, this is immaterial to the SAVE function described above, and it is only necessary that the memory device 112 is storing the content (A.P) when the start signal STA is given.

Thus, in still another modification shown in FIG. 6, the memory device 111 and the gate circuit G1 are substituted by a register RG. The register RG is set with a value (R.P) of the reference position according to a stop signal STP and counts the number of the pulses from the AND gate circuit 110-2 while the output COMP1 of the comparator 107A is "1". With this modification, while the output COMP1 is "1", the content of the actual position representing unit 106 changes from (A.P) to (R.P) while at the same time, the content of the register RG changes from (R.P) to (A.P) with the result that during an interval in which the adjusting piece 102 moves to the reference position, the count of the register RG changes from (R.P) to (A.P).

When the value of the reference position is made to "0", the circuit construction can be more simplified.

Although the circuits shown in FIGS. 4, 5 and 6 were described as digital circuits, a portion or all of the stepping motor 103, actual position representing unit 106, comparator 107A, reference position setting unit 105 and memory device 112 may be formed of analogue elements. For example, use of a servomotor can eliminate the pulse generator 111.

Figure 7:
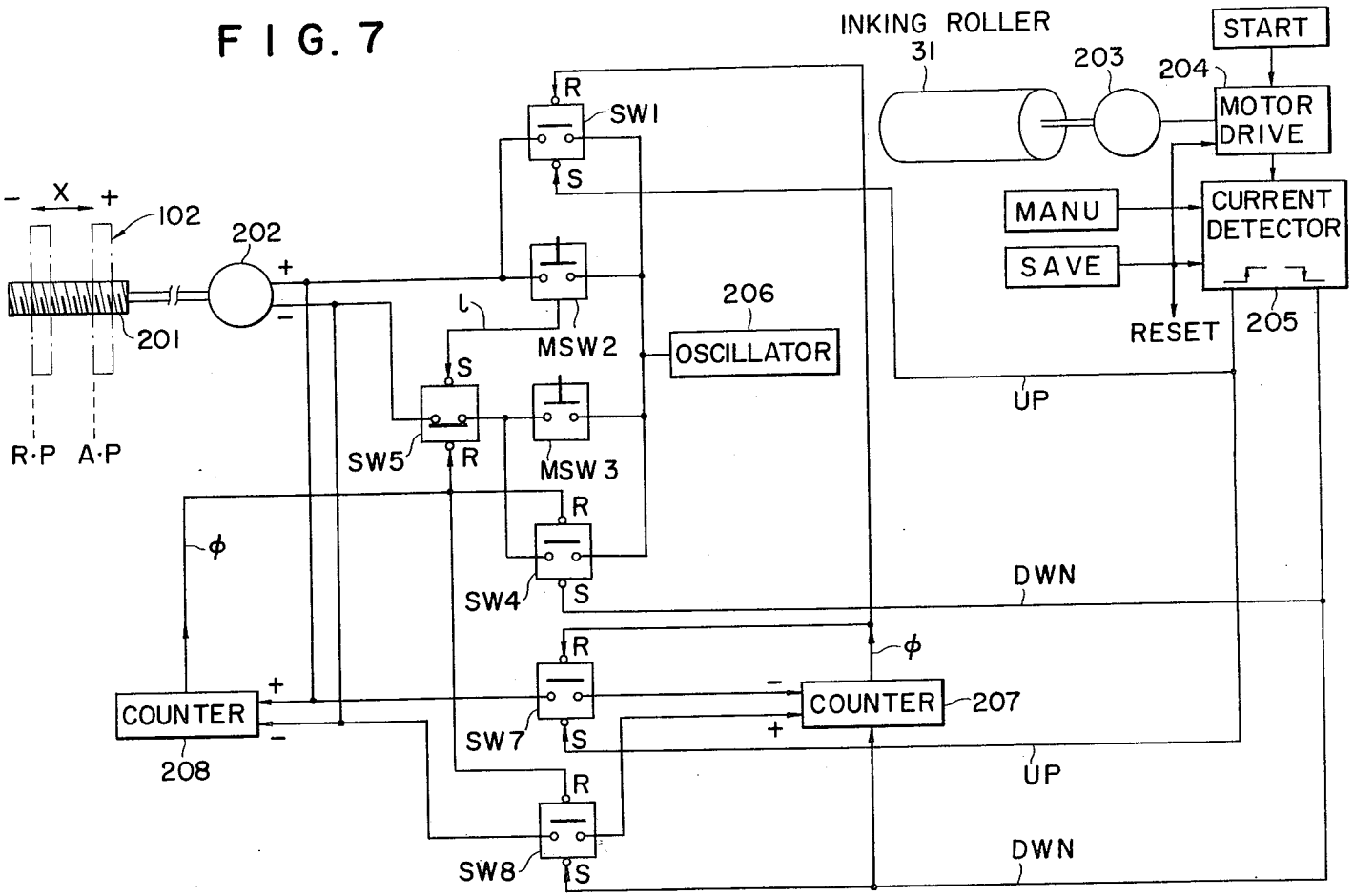
FIG. 7 is a block diagram showing a digital control circuit utilized in this invention.
Figure 8:
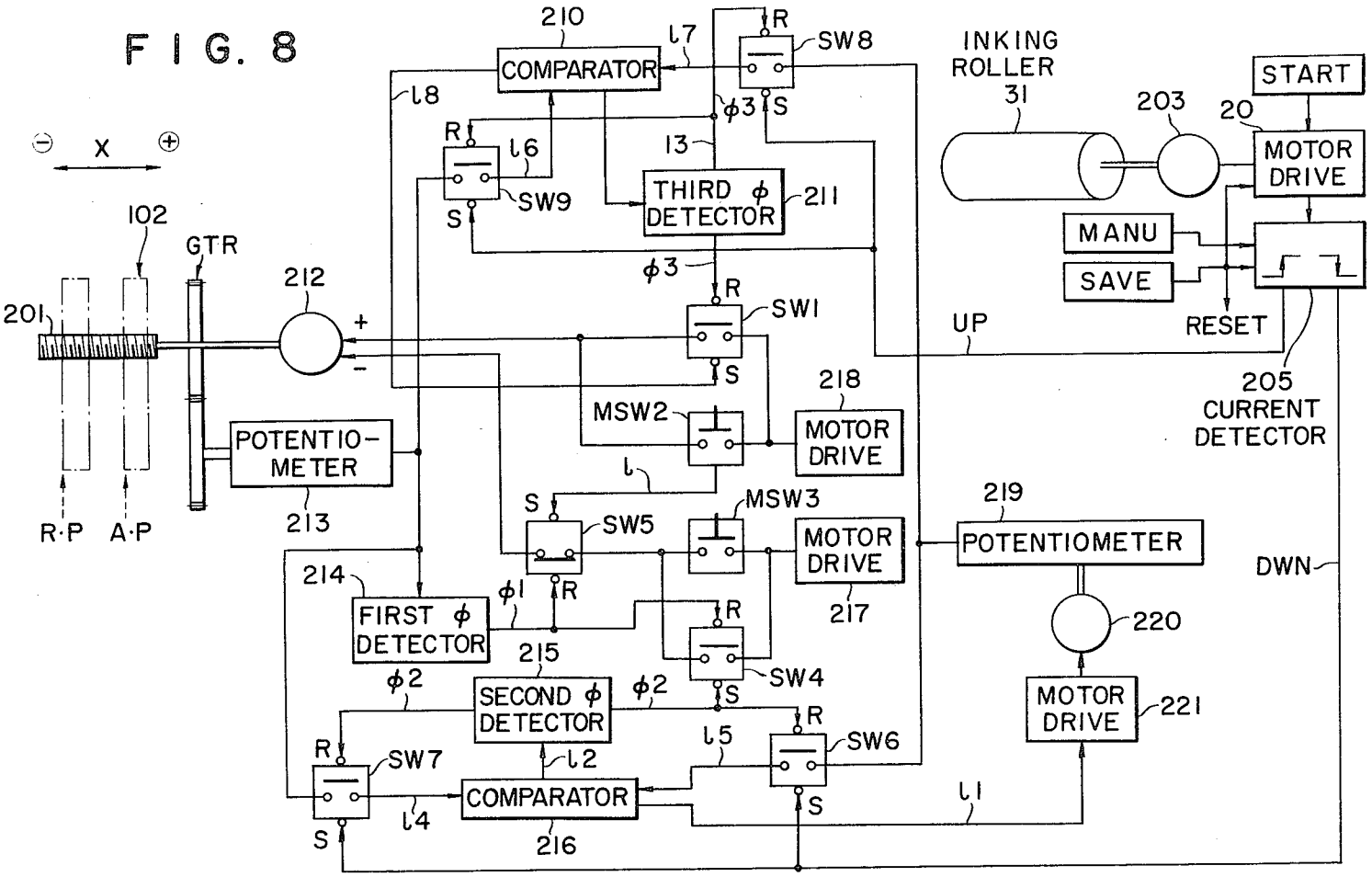
FIG. 8 is a block diagram showing an analogue control circuit utilized in this invention.

It is to be understood that the circuits shown in FIGS. 4–6 are not necessary to be constituted by hardware elements and that some of the hardware elements of a microcomputor may be used in common on the time division basis to accomplish the same object as that of the circuits shown in FIGS. 4–6. When one considers that a plurality of adjusting pieces 102 are generally provided for a single inking roller, use of a microcomputor is effective to miniaturize and simplify the entire construction. FIGS. 7 and 8 show circuit diagrams where the circuits shown in FIGS. 5 and 6 are constructed with digital and analogue elements, respectively.

In FIG. 7, automatic switches SW1, SW4, SW7 and SW8 have the same construction. For example, switch SW1 is constructed such that when an input signal is applied to its lower terminal S the switch is closed or set, whereas when an input signal is applied to its upper terminal R, the switch is opened or reset. These switches SW1–SW8 (except MSW2 and MSW3) may be constructed to use the output of an S-R type flip-flop circuit as a base signal of a power transistor. Manually operated switches MSW2 and MSW3 correspond to push button switches 108-1 and 108-2 shown in FIG. 5, adjusting screw 201 corresponds to the adjusting screw 101 shown in FIG. 5, stepping motor 202 to stepping motor 103, oscillator 206 to the pulse generator 111, and pulse amplifier 110-3, counter 208 to the actual position representing unit 106, counter 207 to register RG (FIG. 6), current detector 205 to inking roller rotating state judging unit 104A, respectively.

In FIG. 7 203 shows a motor for driving the inking roller and 204 a motor drive circuit of the motor 203.

A manual operation is performed as follows.

At first when a manual operation instruction MANU is applied to the current detector 205 it will not produce UP and DOWN outputs. Suppose now that all switches SW1–SW8 (except switch SW5 which has been set by the initializing operation caused by the closure of a source switch, not shown) are applied with a reset signal to their reset terminals R (corresponding to the cleared state of the flip-flop circuit described above). Under these conditions, depression of the manual switch MSW2, applies the pulse generated by the oscillator 206 to the plus terminal of the stepping motor 202 to rotate the adjusting screw 201 for moving the adjusting piece 102 in the direction of +X thus increasing the quantity of the ink supplied. When the switch MSW2 is closed the switch SW5 is maintained at a set state set through a line l.

When the manual switch MSW3 is closed, the pulse from the oscillator 206 is applied to the minus terminal of the stepping motor 202 via switches MSW3 and SW5 so as to move the adjusting piece 102 in the direction of −X. As shown, pulses corresponding to the plus and minus terminals of the stepping motor 202 are applied to the reversible counter 208. The reversible counter 208 is preset such that its count would be zero when the adjusting piece 102 is at the reference position R.P so that when the adjusting piece is moved to the reference position R.P in the direction of −X by the operation of switch MSW3. The counter 208 produces a zero output (output $\phi$) which resets the switch SW5 thus interrupting the supply of the pulse to the stepping motor.

Where a SAVE signal is applied to the current detector 205, the circuit operates as follows.

Thus, when the SAVE signal is applied, the current detector 205 becomes effective to produce output signals UP and DWN, which respectively correspond to the start and stop instructions for the motor drive circuit 204. When a SAVE signal is applied while the inking roller 31 is rotating and the adjusting piece 102 is at the position A.P, the motor drive circuit 204 would stop the motor 203.

Consequently, whenever the current supplied to the motor 203 is less than a predetermined value, the current detector 205 produces a signal DWN to clear the reversible counter 207, that is it is set to the reference position. In addition, as the signal DWN sets or closes the switches SW4 and SW8, the pulse generated by the oscillator 206 is applied to the minus terminal of the stepping motor 202 and to the minus terminal of the reversible counter 208 through these switches. Furthermore, the pulse is applied to the plus terminal of the reversible counter 207 via switch SW8. Consequently, the adjusting piece 102 is moved from the actual position A.P to the reference position R.P in the direction of −X.

This movement continues until the count of the counter 208 reduces to zero. Then the count of the counter 207 becomes the value (A.P) which was initially held by the counter 208 and its output $\phi$ resets switches Sw4, SW5 and SW8.

A start instruction START is applied to the motor drive circuit 204 for rotating the inking roller 31, and the current detector 205 produces a signal UP which sets switches SW1 and SW7 so that the pulse generated by the oscillator 206 is applied to the plus terminal of the stepping motor 202 and to the plus terminal of the counter 208 via the switch SW1 and to the minus terminal of the counter 207 via switch SW7. Consequently, the adjusting piece 102 at the reference position R.P is moved toward the actual position A.P in the direction of +X. In response to a pulse train when the count of the counter 207 changes from (A.P) to (R.P) that is zero, the count of the counter 208 changes from zero to (A.P). At the same time, since the output $\phi$ of the counter 207 resets switches SW1 and SW7, supply of the pulse to the stepping motor 202 is terminated. At this time, the adjusting piece 102 is returned to the actual position A.P at which the SAVE signal was given.

In a modification shown in FIG. 8, the counter 208 (for the actual position) and the counter 207 (acting as a memory device) are substituted by a potentiometer resistor. In this embodiment, in the manual operation, the inking roller 31 is rotated by the START signal, whereas when a signal MANU is applied to the current detector 205, it will not produce outputs UP and DOWN. Under these conditions depression of the manual switch MSW2 applies driving current to the plus terminal of motor 212 from a motor drive unit 218 so that the adjusting piece 102 is moved in the direction of +X by the adjusting screw 201 to increase the gap between the inking roller 31 and the adjusting piece 102. At this time, a potentiometer resistor 213 is rotated through a gear train GTR.

A first $\phi$ detector 214 is provided to produce an output $\phi_1$ when the output of the potentiometer resistor 213 corresponds to the reference position R.P at which the quantity of the ink supplied is zero.

Depression of the manual switch MSW3 applies a drive signal from a motor drive unit 217 to the minus terminal of the motor 213 via switches MSW3 and SW5 to move the adjusting piece 102 in the direction of −X. When the adjusting piece 102 reaches the reference position R.P, the output of the potentiometer resistor 213 at this time is judged by the first $\phi$ detector 214 as an output corresponding to the reference position so that the first $\phi$ detector 214 produces an output $\phi_1$ which resets the switch SW5 to stop the motor 212.

A case utilizing the SAVE function will now be described. It is assumed now that the inking roller 31 is rotating at a predetermined speed and that the adjusting piece 102 is at the position A.P. Where a SAVE signal is applied, respective switches SW1–SW9 (except SW5) are reset, while switch SW5 is set. Accordingly, the drive circuit 20 of the motor 203 is deenergized, whereby the current detector 205 produces a signal DWN to reset switches SW6 and SW7. Thus, the output of the potentiometer resistor 213 is applied to an analogue comparator 216 via switch SW7 and a line $l_4$, and the output of a potentiometer resistor 219 is applied to the comparator 216 through switch SW6 and a line $l_5$. The potentiometer resistor 219 may have any initial value. The analogue comparator 216 compares the signals on lines $l_4$ and $l_5$ with each other to apply through a line $l_1$ to a drive circuit 221 for motor 220 a signal representing the difference between two signals. In this manner, the motor 220 is driven until the outputs of both potentiometer resistors 219 and 213 become equal. In other words, the output value of the potentiometer resistor 213 is transferred to the potentiometer resistor 219. A signal representing the difference between signals on lines $l_4$ and $l_5$ is applied to a second $\phi$ detector 215 over a line $l_2$ so that upon coincidence of the signals on lines $l_4$ and $l_5$, the second $\phi$ detector 215 produces a coincidence signal $\phi_2$ which resets switches SW7 and SW6 and sets switch SW4. As a signal from the motor drive circuit 217 is applied to the minus terminal of the motor 212 through switches SW4 and SW5 to drive the motor in the −X direction, the adjusting piece 102 is moved in the −X direction from the actual position to the reference position. As a consequence, the potentiometer resistor 213 too is rotated and its output is checked by a first $\phi$ detector 214 which detects an output corresponding to the reference position R.P. As soon as the adjusting piece 102 reaches the reference position R.P, the $\phi$ detector 214 produces an output $\phi_1$ which is turn resets switches SW4 and SW5 thereby deenergizing the motor 212.

As a result of the operation described above the output (of a value corresponding to the actual position A.P) of the potentiometer resistor 213 is shifted to the potentiometer resistor 219 and only when the adjusting piece 102 is moved to the reference position R.P the potentiometer resistor 213 produces an output corresponding to the reference position R.P.

Application of a signal START for restarting, causes the inking roller 31 to restart from stop state, with the result that the current detector 205 produces a signal UP. Since this signal UP resets the switches SW8 and SW9, the output of the potentiometer resistor 219 is applied to the analogue comparator 210 via lines $l_7$ and $l_6$. When the signals on lines $l_7$ and $l_6$ do not coincide with each other, the comparator 210 applies a set signal to switch SW1 over line $l_8$ so that the drive circuit 218 applies its output to the plus terminal of motor 212 via switch SW1 whereby the adjusting piece 102 is moved to the actual position A.P from the reference position R.P. Then the output of the potentiometer 213 coincides with that of the potentiometer resistor 219 so that a third $\phi$ detector 211 produces a coincidence signal $\phi_3$ which resets the switch SW1 to deenergize the motor 212. Furthermore, the signal $\phi_3$ resets switches SW8 and SW9, thereby returning the adjusting piece 109 to the original position A.P.

As above described, according to this invention, when the rotation of an inking roller is stopped since an adjusting piece is brought back to a reference position where printing ink would not leak, loss of ink can be prevented while the inking roller is maintained in a stop state. Moreover, since the control apparatus is provided with a SAVE function according to which an actual position A.P of the adjusting piece at the time of stopping the inking roller is stored in a memory device or the like and the stored position is read out therefrom when a restart instruction is given so as to automatically bring back the adjusting piece to that position A.P it is not necessary to readjust the quantity of ink at the time of restarting.

Accordingly, not only the operational efficiency of a printing machine can be improved but also the restarting is made easy.

I claim:

1. Inking control apparatus for use in a printing machine including an inking roller, an adjusting piece confronting said inking roller for defining therebetween an ink reservoir and an adjustable gap communicated with said ink reservoir for supplying a quantity of ink; and drive means for reciprocating said adjusting piece toward and away from said inking roller to adjust said gap to a predetermined width, said inking control apparatus comprising:

actual position representing means for storing data corresponding to the gap width between said inking roller and said adjusting piece for representing an actual position thereof;

reference position setting means for setting a reference position for said adjusting piece, said reference position forming a gap between said inking roller and said adjusting piece of a width sufficient to prevent said ink from leaking through said gap;

comparator means for comparing outputs of said actual position representing means and said reference position setting means for producing an output until said outputs coincide with each other;

inking roller rotating state judging means which produces a stop signal when said inking roller stops to rotate or approaches to a stop state; and gate circuit means supplied with said output of said comparator means for operating said drive means in accordance with said stop signal thereby maintaining said adjusting piece at said reference position while said inking roller is being stopped.

2. Inking control apparatus for use in a printing machine including an inking roller, an adjusting piece confronting said inking roller for defining therebetween an ink reservoir and an adjustable gap communicated with said ink reservoir for applying a quantity of ink; and drive means for reciprocating said adjusting piece toward and away from said inking roller to adjust said gap to a predetermined width, said inking control apparatus comprising:

actual position representing means for storing data corresponding to the gap width between said inking roller and said adjusting piece for representing an actual position thereof;

reference position setting means for setting a reference position for said adjusting piece, said reference position forming a gap between said inking roller and said adjusting piece of a width sufficient to prevent said ink from leaking through said gap;

inking roller rotating state judging means which produces a stop signal when said inking roller stops to rotate or approaches to a stop state, and a start signal when said inking roller is rotating at a predetermined speed or at a starting condition;

memory means responsive to said stop signal for transferring data regarding the actual position of said adjusting piece stored in said actual position representing means to said memory means;

comparator means which compares content of said actual position representing means with that of said reference position setting means when said stop signal is applied for producing a first output until said compared contents coincide with each other, and compares the content of said actual position representing means with that of said memory means when said start signal is given for producing a second output until said compared contents coincide with each other;

transfer gate means responsive to said start and stop signals for supplying the contents of said reference position setting means and said memory means; and gate means responsive to said first and second outputs of said comparator means for applying a drive signal to said drive means for moving said adjusting piece toward and away from said inking roller.

3. The control apparatus according to claim 1 or 2 which further comprises detecting means which detects variation in distance between an axis of rotation of said inking roller and a center of reciprocating movement of said adjusting piece for producing an output, and correcting means for modifying the content of said reference position according to a detected variation.

4. The control apparatus according to claim 2 wherein said memory means varies its content in accordance with an output of said actual position setting means, an output of said comparator means, said stop signal and a signal applied to said drive means.

5. The control apparatus according to claim 2 which further comprises means for transferring the content of said actual position representing means to said memory means in response to said stop signal prior to a variation of the content of said actual position representing means caused by said first output of said comparator means.

* * * * *